United States Patent [19]

Tuovinen et al.

[11] Patent Number: 4,622,677

[45] Date of Patent: Nov. 11, 1986

[54] METHOD AND DEVICE FOR CLAMPING THE ELECTRODE CONTACT SHOES AROUND THE ELECTRODE OF AN ELECTRIC FURNACE

[75] Inventors: Heikki Tuovinen, Ulvila; Kauko K. Rinne, Noormarkku; Matti Honkaniemi, Tornio; Risto M. Heikkilä, Haaparanta; Martti Jankkila, Kiviranta, all of Finland

[73] Assignee: Outokumpu Oy, Helsinki, Finland

[21] Appl. No.: 459,528

[22] PCT Filed: May 28, 1982

[86] PCT No.: PCT/FI82/00020

§ 371 Date: Jan. 13, 1983

§ 102(e) Date: Jan. 13, 1983

[87] PCT Pub. No.: WO82/04372

PCT Pub. Date: Dec. 9, 1982

[30] Foreign Application Priority Data

May 12, 1982 [FI] Finland ..... 811649

[51] Int. Cl.[4] ..... H05B 7/10

[52] U.S. Cl. ..... 373/101

[58] Field of Search ..... 373/94–101

[56] References Cited

U.S. PATENT DOCUMENTS

| | | | |
|---|---|---|---|
| 2,551,420 | 5/1951 | Conti | 373/101 X |
| 2,758,145 | 8/1956 | Bjerkas | 373/94 |
| 2,884,475 | 4/1959 | Foyn | 373/94 |
| 2,921,108 | 1/1960 | Meffert | 373/100 X |
| 3,524,004 | 8/1970 | Van Nostran et al. . | |
| 3,692,917 | 9/1972 | Seifert et al. | 373/101 |
| 4,238,634 | 12/1980 | Krogsrud . | |

FOREIGN PATENT DOCUMENTS

| | | |
|---|---|---|
| 956969 | 1/1957 | Fed. Rep. of Germany . |
| 1120038 | 12/1961 | Fed. Rep. of Germany . |
| 1142425 | 1/1963 | Fed. Rep. of Germany . |
| 1165783 | 3/1964 | Fed. Rep. of Germany . |
| 754641 | 8/1956 | United Kingdom . |

*Primary Examiner*—Roy N. Envall, Jr.

*Attorney, Agent, or Firm*—Pennie & Edmonds

[57] ABSTRACT

A method and device for clamping the electrode contact shoes (2) around the electrode (1) of an electric furnace, comprising one pressure element (3) which is advantageously hydraulically operated and uniform and which surrounds the electrode contact shoes and clamps them against the electrode (1) under the action of pressure on the pressure element.

5 Claims, 7 Drawing Figures

METHOD AND DEVICE FOR CLAMPING THE ELECTRODE CONTACT SHOES AROUND THE ELECTRODE OF AN ELECTRIC FURNACE

BACKGROUND OF THE INVENTION

1. Field of the Invention

The present invention relates to a method and device for clamping the electrode contact shoes around the electrode of an electric furnace, such as an electric arc furnace.

2. Description of Related Art

The electrodes of electric furnaces are customarily held by means of electrode contact shoes which grip around the electrode and are clamped against the electrode by means of mechanical devices or devices working by fluid.

In many cases the holder accordingly acts also as a contact shoe and thus transmits the electric current. In present practice the number of contact shoes around the electrode is relatively small. The device includes means for mounting at least one continuous pressure element and a plurality of closely spaced electrode contact shoes. This arrangement has been arrived at because the force clamping the contact shoes against the electrode is produced separately for each individual contact shoe.

The clamping force is produced, for example, with the aid of a rubber membrane which is fashioned to fit the contact shoe closely and to which insignificant pressure is applied.

Such rubber membranes, however, are costly to manufacture. Their maintenance and installation are troublesome because each one of them requires its own individual hydraulic unit but nevertheless it is not possible to replace one rubber membrane or contact shoe without dismantling the entire pressure ring system. It has not proved possible to seal the gaps between the contact shoes and consequently the hot furnace gases escape through these gaps so that there is an obvious danger of the rubber membranes becoming burnt. The contact area between the electrode and the contact shoes through which the current is supplied is often quite small compared with the available area, in other words only a line contact is achieved. As the number of contact shoes is small their size in the vertical direction must be correspondingly greater in order that even with only a line contact a sufficient flow of current to the electrode is achieved.

SUMMARY OF THE DISCLOSURE

An object of this invention is to avoid the drawbacks of prior known devices and to provide a method and device by means of which clamping of the contact shoes to the electrode is achieved in a simpler and cheaper fashion and by means of which it is simple to replace a single contact shoe and by means of which the system is made tight. Moreover, by the aid of pressure fluid the cooling of the contact shoes can be arranged easily.

All the above-mentioned advantages are provided by a method and device, the principal characteristics of which are given in the accompanying patent claims.

BRIEF DESCRIPTION OF THE DRAWINGS

The invention is described in more detail with reference to the accompanying drawings, wherein.

DESCRIPTION OF THE PREFERRED EMBODIMENT

In the device according to the invention the number of contact shoes 2 is increased, and the force clamping the contact shoes to the electrode 1 is achieved by means of a pressure element 3, comprising one part or several parts one above the other, which as one or several uniform rings presses with the same pressure against all the contact shoes.

By means of this uniform pressure element 3 such close contact is obtained between the electrode and the contact shoes that even if the pressure element consists of several parts it can, nevertheless, be served by a single hydraulic unit.

Using the considerably simplified pressure element 3 according to the invention it is also possible to considerably increase the number of the contact shoes 2. The width of these contact shoes 2 is then correspondingly decreased. As a consequence of their larger number, the size of the contact shoes can be decreased also in the vertical direction because with the larger number of shoes more vertical line contacts are obtained than with the smaller number of contact shoes used heretofore. An advantage of the decreased size of the contact shoes is that they are considerably easier to manufacture and also that the maintenance and replacement of individual shoes can be carried out even by one man.

The pressure element 3 according to the invention is in its simplest embodiment a tubular pressure element surrounding the contact shoes and into which a hydraulic pressure is introduced. The inlet and outlet ends of the tube are formed to fit one another so closely that also in their region the contact shoes are clamped tightly to the electrode. The tubular element may surround the contact shoes 2 in several turns, and it can, if necessary, consist of several different elements. Even in this case the replacement of a defective element is considerably simpler than in prior known devices, in which the rubber membrane is tightly joined to the contact shoe and in which it is necessary to dismantle the whole pressure ring system in order to replace a single membrane.

The fluid by which the hydraulic pressure is produced in the pressure element 3 is circulated and thus serves at the same time to cool the pressure element. In prior known devices the fluid within the rubber membrane is not circulated and so does not provide cooling.

The pressure element 3 according to this invention or one part of said pressure element is easily replaceable, e.g. in the event of a leakage, since the pressure ring system comprising the contact shoes and the pressure element can be lifted up as a whole without dismantling it, and the defective contact shoes or pressure element or some part thereof can then easily be replaced.

Maintenance is simplified if a suction is applied to the pressure element, after which either a contact shoe 2 or some part of the pressure element or the whole element can be replaced.

Figure 1:
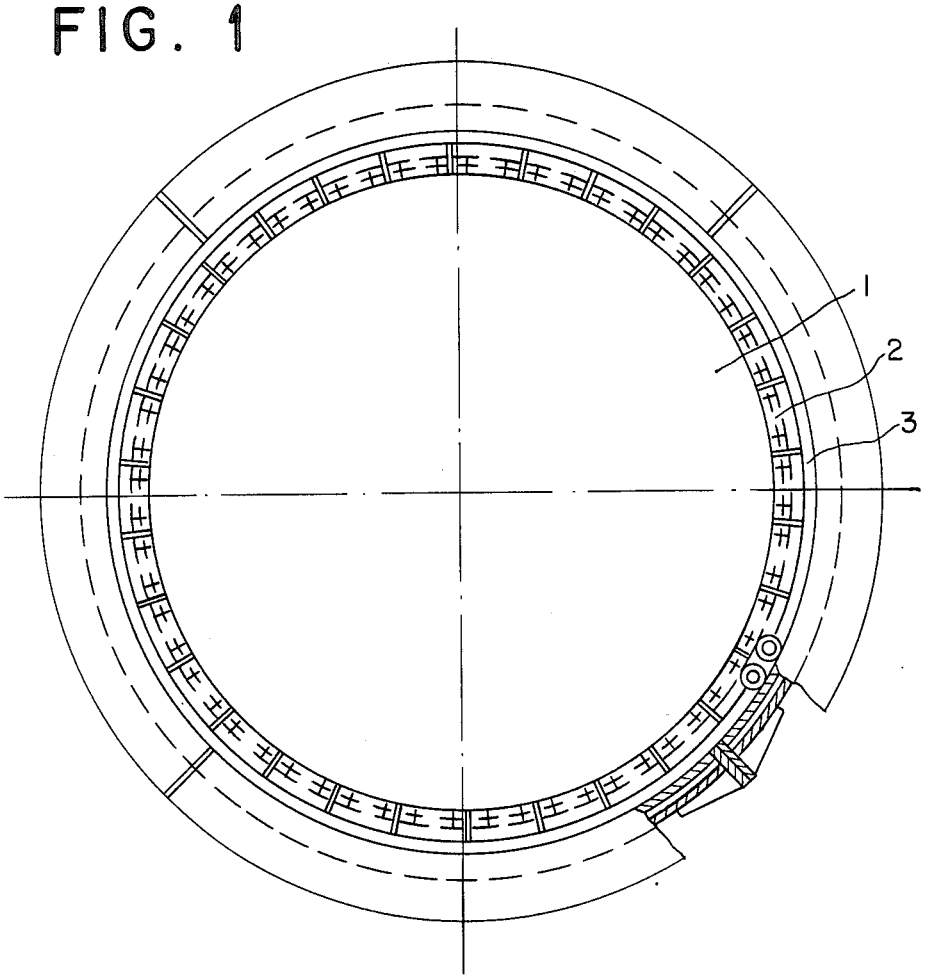
FIG. 1 is a horizontal cross-sectional view of an electrode around which are the contact shoes and the pressure element clamping them.
Figure 3:
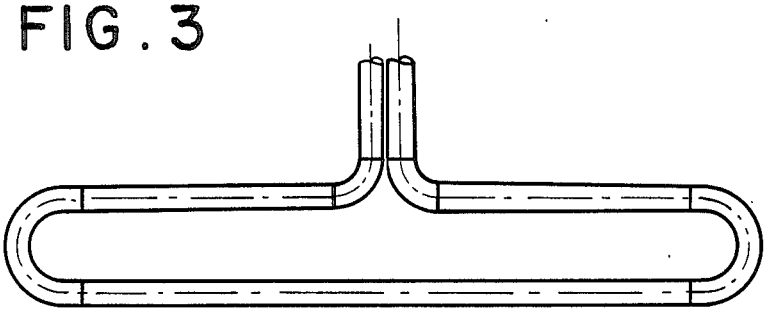
FIG. 3 is a view of one embodiment of the pressure ring.
Figure 4:
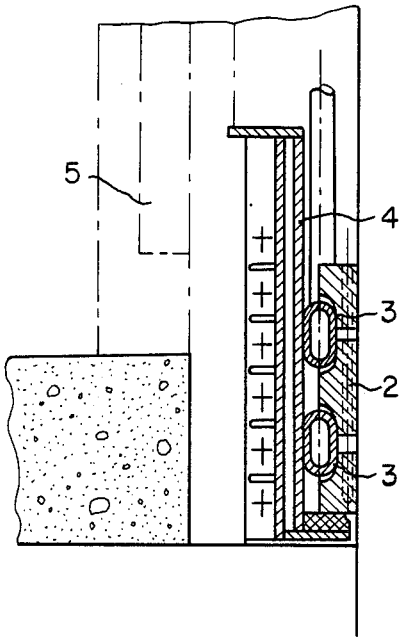
FIG. 4 is a vertical cross-sectional view of a pressure ring system employing the pressure element of FIG. 3.

In FIG. 3 a view of one embodiment of the pressure element is shown. The pressure element 3 forms one double loop for essentially the whole circumference of the electrode. In this case, in a vertical section, cross-sections of both branches of the pressure element, one above the other, are seen, as is illustrated in FIG. 4. At the points where the element turns back upon itself and at the inlet and outlet points particular care must naturally be given to the form of the element, since otherwise the clamping force applied to the contact shoes 2 at these points might be deficient.

Figure 2:
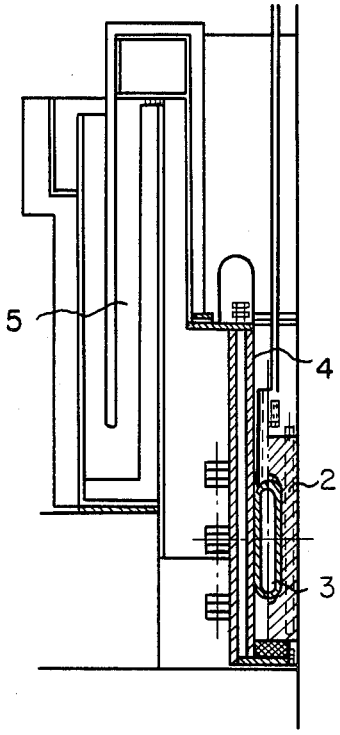
FIG. 2 is a vertical cross-sectional view of the pressure ring system surrounding the electrode.
Figure 5:
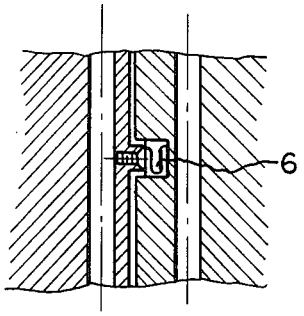
FIG. 5 illustrates the sealing spring between the contact shoes.

The parts which are important in respect of the sealing of the device are shown in FIGS. 2 and 5. In FIG. 2 a water-cooled metal structure is shown, denoted by the number 4, which acts as a supporting structure both generally and in particular for the outer circumference of the pressure element 3. To prevent the escape of furnace gases the device is additionally fitted with a water lock, which in FIG. 2 is denoted in its entirety by the reference number 5. Possible points of leakage are the vertical gaps between the contact shoes 2. The sealing of these gaps is illustrated in FIG. 5.

Figure 6:
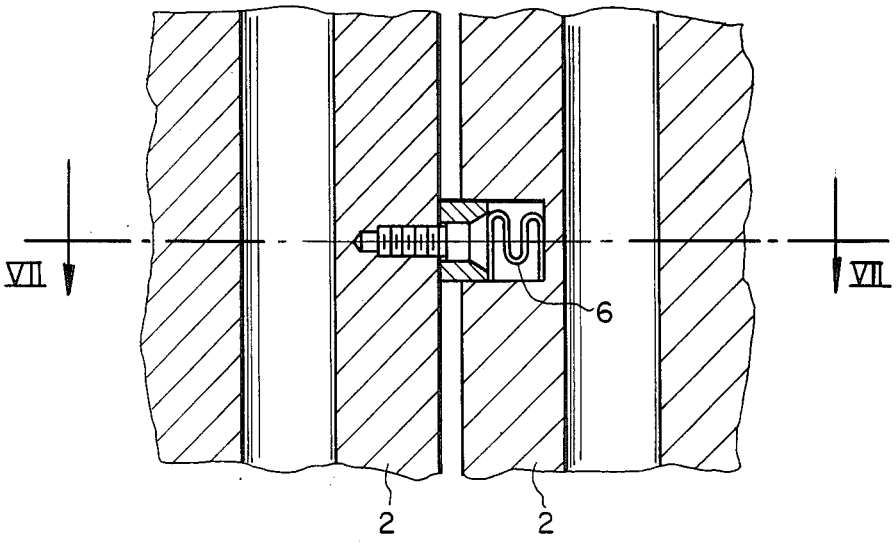
FIG. 6 is a longitudinal cross-section through two adjacent shoes showing the sealing spring of the present invention in more detail.
Figure 7:
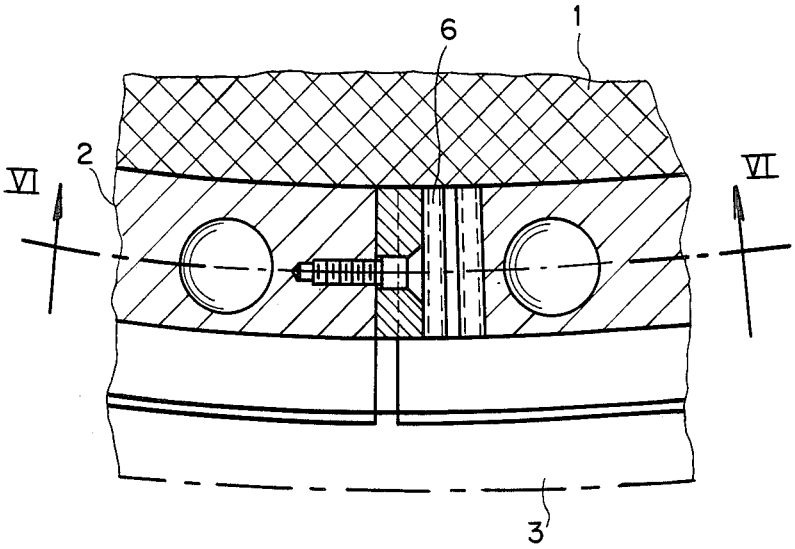
FIG. 7 is a horizontal cross-section along line 7—7 of FIG. 6.

Grooves are made in adjacent contact shoes 2 in the direction of their thickness at the position of the pressure element, and in these grooves is fitted a suitably formed flat sealing spring 6 which seals the gap which remains between the contact shoes 2. In this way the leakage between the contact shoes 2, which was a generally occurring drawback in earlier designs, has also been sealed. The spring fits into the grooves formed within the shoes, as shown in FIGS. 6 and 7. The spring in this way seals the gap which remains between the contact shoes 2 by running transverse to the direction of the shoes and bridging the gap between the shoes. The spring is mounted as shown using a threaded screw or bolt. The spring has a wavy shape which assists in maintaining the spring's position.

We claim:

1. A device for clamping and cooling electrode contact shoes mounted with gaps therebetween around the electrode of an electric furnace, comprising (a) at least one continuous hydraulic pressure element adapted for circulating a hydraulic fluid, substantially surrounding and contacting all of the contact shoes, the contact shoes being at least fifteen in number, closely spaced and substantially completely surrounding the electrode, (b) at least one sealing spring mounted between each pair of adjacent contact shoes to seal the gaps between the contact shoes to substantially prevent passage therebetween of gases from the electric furnace and thereby isolate said pressure element from said gases, (c) a rigid support structure surrounding, supporting and contacting said hydraulic pressure element, and (d) means for circulating a hydraulic fluid in the pressure element to produce an essentially uniform inward hydraulic pressure to clamp the contact shoes tightly around the electrode.

2. A device as in claim 1, wherein each sealing spring is mounted adjacent to the pressure element.

3. A device as in claim 1, wherein each sealing spring is mounted in grooves formed in the contact shoes adjacent to the pressure element.

4. A method of clamping and cooling at least fifteen closely spaced electrode contact shoes mounted with gaps therebetween completely around an electrode of an electric furnace, comprising (a) mounting at least one continuous hydraulic pressure element, in which a hydraulic fluid can be circulated, in substantially surrounding and contacting relation to all of the contact shoes, (b) surrounding and supporting said hydraulic pressure element with a rigid support structure, (c) circulating a hydraulic fluid in said pressure element in a direction encircling said contact shoes so as to produce an essentially uniform inward hydraulic pressure to clamp the contact shoes tightly around the electrode, and (d) mounting at least one sealing spring between each pair of adjacent contact shoes to seal the gaps between the adjacent contact shoes to substantially prevent passage therebetween of gases from the electric furnace and thereby isolate said pressure element from said gases.

5. A device for clamping and cooling a plurality of closely spaced electrode contact shoes mounted with gaps therebetween around the electrode of an electric furnace, said shoes being more than fifteen in number, comprising:

(a) at least one continuous hydraulic pressure element adapted for circulating a hydraulic fluid, substantially surrounding and contacting all of the contact shoes, (b) a rigid support structure surrounding, supporting and contacting said hydraulic pressure element, (c) means for circulating a hydraulic fluid in said pressure element in a direction around said contact shoes to produce an essentially uniform inward hydraulic pressure to clamp the contact shoes tightly around the electrode, and to cool the contact shoes, and (d) at least one sealing spring mounted between each pair of adjacent contact shoes to seal the gaps between the adjacent contact shoes to substantially prevent passage therebetween of gases from the electric furnace and thereby isolate said pressure element from said gases.

* * * * *